US007439837B2

(12) United States Patent
McDonald

(10) Patent No.: US 7,439,837 B2
(45) Date of Patent: Oct. 21, 2008

(54) ARTICLE OF FOOTWEAR INCORPORATING A HEEL STRAP SYSTEM

(75) Inventor: Steven C. McDonald, Heber, UT (US)

(73) Assignee: Nike, Inc., Beaverton, OR (US)

( * ) Notice: Subject to any disclaimer, the term of this patent is extended or adjusted under 35 U.S.C. 154(b) by 253 days.

(21) Appl. No.: 11/341,867

(22) Filed: Jan. 30, 2006

(65) Prior Publication Data

US 2007/0175065 A1 Aug. 2, 2007

(51) Int. Cl.
*A43B 3/12* (2006.01)
*A43B 3/24* (2006.01)

(52) U.S. Cl. ..... 336/11.5; 36/58.5; 36/58.6

(58) Field of Classification Search ..... 36/11.5, 36/105, 58.5, 58.6
See application file for complete search history.

(56) References Cited

U.S. PATENT DOCUMENTS

| | | | | | |
|---|---|---|---|---|---|
| 866,598 | A * | 9/1907 | Price | 36/58.5 |
| 1,410,907 | A * | 3/1922 | Garfinkle | 36/11.5 |
| 1,686,175 | A * | 10/1928 | Read | 36/58.5 |
| 1,989,613 | A * | 1/1935 | Disch | 36/105 |
| 2,024,729 | A * | 12/1935 | Gustin | 36/108 |
| 2,062,909 | A * | 12/1936 | Kenagy, Sr. et al. | 36/11.5 |
| 2,711,033 | A * | 6/1955 | Dick | 36/11.5 |
| 2,736,110 | A * | 2/1956 | Hardimon | 36/58.5 |
| 2,920,402 | A * | 1/1960 | Minera | 36/58.5 |
| 4,183,156 | A | 1/1980 | Rudy | |
| 5,615,496 | A * | 4/1997 | Sharpstein | 36/11.5 |
| 7,222,442 | B2 * | 5/2007 | Hillyer et al. | 36/11.5 |
| 2004/0055179 | A1 | 3/2004 | Wang | |
| 2006/0075656 | A1 * | 4/2006 | Januszewski et al. | 36/11.5 |
| 2006/0090374 | A1 * | 5/2006 | Hillyer et al. | 36/100 |

FOREIGN PATENT DOCUMENTS

JP 08322602 A2 12/1996

* cited by examiner

*Primary Examiner*—Marie Patterson
(74) *Attorney, Agent, or Firm*—Banner & Witcoff, Ltd.

(57) ABSTRACT

An article of footwear for receiving a foot of a wearer. The footwear includes an upper and a sole structure secured to the upper. The footwear also includes a heel strap having a U-shaped configuration with a pair of end areas and a central area. The end areas are secured to at least one of the upper and the sole structure, and the central area is unsecured to the upper and the sole structure. At least one of the upper and the sole structure define a foot-supporting surface with a raised periphery in at least a heel region of the footwear, and the central area of the heel strap is a contoured area that lays adjacent the raised periphery in the heel region. The strap may be separated from the foot-supporting surface and placed around a heel of the foot.

29 Claims, 16 Drawing Sheets

9B
41
41
40

42
42

41
42

40
9A
42
9A
42
40
43
9B
43
40

ARTICLE OF FOOTWEAR INCORPORATING A HEEL STRAP SYSTEM

BACKGROUND

Conventional articles of footwear include two primary elements, an upper and a sole structure. The upper provides a covering for at least a portion of the foot that comfortably receives and securely positions the foot with respect to the sole structure.

The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of ambulatory activities, including walking and running.

The upper is often secured (e.g., by adhesives or stitching) to the sole structure to form a void for receiving the foot. A variety of material may be utilized for the upper, including leather, synthetic leather, and various textiles. A foam material may be located on the interior of the upper to enhance the comfort of the upper, and moisture-wicking textiles may be positioned adjacent the foot to limit the quantity of perspiration within the upper.

In open heel footwear, such as a sandal and clog, the upper generally covers at least a portion of a forward area of the foot and leaves a heel area of the foot exposed. More particularly, the upper of a sandal exposes at least a portion of the toes, whereas the upper of a clog covers substantially all of the forward area of the foot. In both a sandal and a clog, the heel area of the upper is generally left open, which allows the foot to enter and exit the footwear in a relatively easy manner.

In either a sandal or a clog, sole structure may be a single foam element, or the sole structure may have a foam midsole layer and a rubber outsole layer, for example. The sole structure may also include a sockliner, which is a thin, cushioning member located adjacent to a plantar (i.e., lower) surface of the foot to enhance footwear comfort. Although the sole structure is generally secured to the upper in a permanent manner, some articles of footwear with the open heel configuration may incorporate removable or interchangeable sole structure elements.

SUMMARY

One aspect of the invention is an article of footwear for receiving a foot of a wearer. The footwear includes an upper and a sole structure secured to the upper. The footwear also includes a heel strap having a U-shaped configuration with a pair of end areas and a central area. The end areas are secured to at least one of the upper and the sole structure, and the central area is unsecured to the upper and the sole structure. At least one of the upper and the sole structure define a foot-supporting surface with a raised periphery in at least a heel region of the footwear, and the central area of the heel strap is a contoured area that lays adjacent the raised periphery in the heel region.

Another aspect of the invention is a method of assembling an article of footwear. The method includes providing a combination of an upper and a sole structure that are secured together, the upper extending over at least a front portion of a foot, and the sole structure having sides and a heel portion. The method also includes attaching two ends of a heel strap having a contoured and U-shaped configuration to the sides of the sole structure. A central area of the heel strap is located around a periphery of an upper surface of the sole structure in at least the heel portion of the footwear such that contours of the central area lay adjacent the periphery.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following discussion and accompanying figures disclose various articles of footwear having an open heel configuration. More particularly, an article of footwear 10 is disclosed in FIGS. 1-9B as having the configuration of a sandal, and an article of footwear 10' is disclosed in FIGS. 10-14B as having the configuration of a clog. As discussed in the Background section above, in both a sandal and a clog, the heel area of the upper is generally left open, which allows the foot to enter and exit the footwear in a relatively easy manner. In order to selectively limit the ease with which the foot exits the footwear, for example, both footwear 10 and footwear 10' incorporate a strap system, as discussed in greater detail below.

Figure 1:
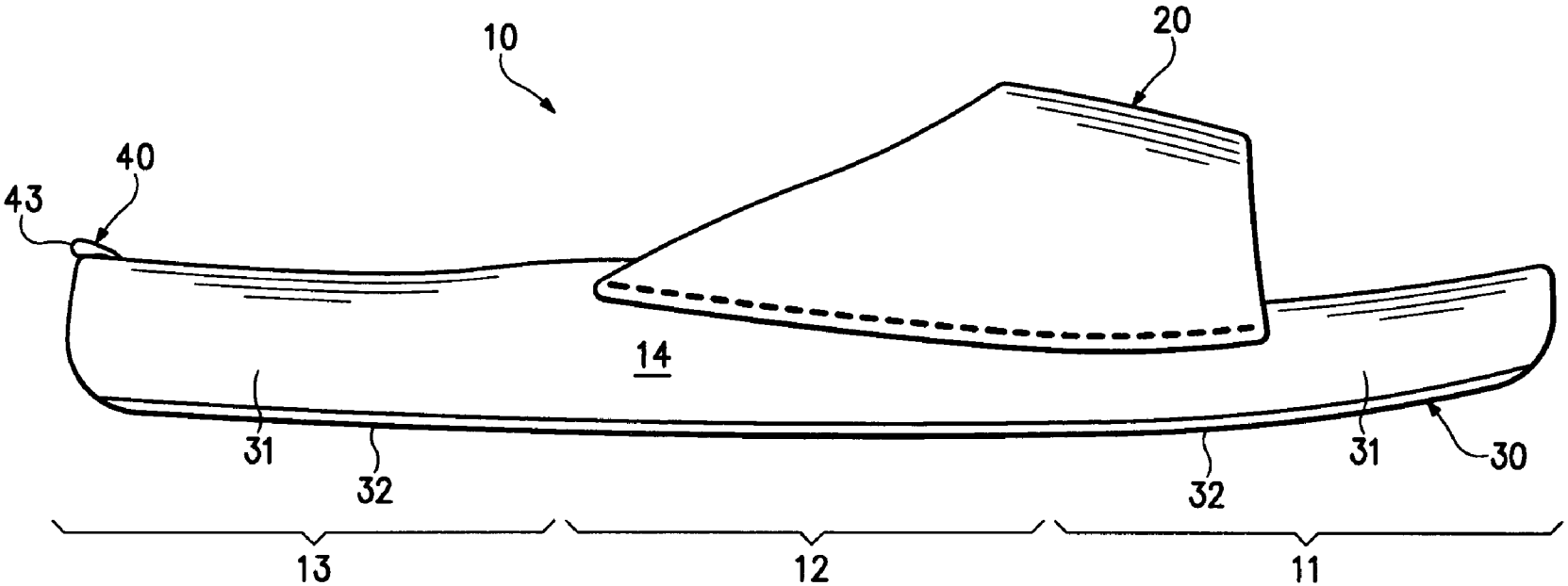
FIG. 1 is a lateral side elevational view of a first article of footwear having a configuration of a sandal.
Figure 2:
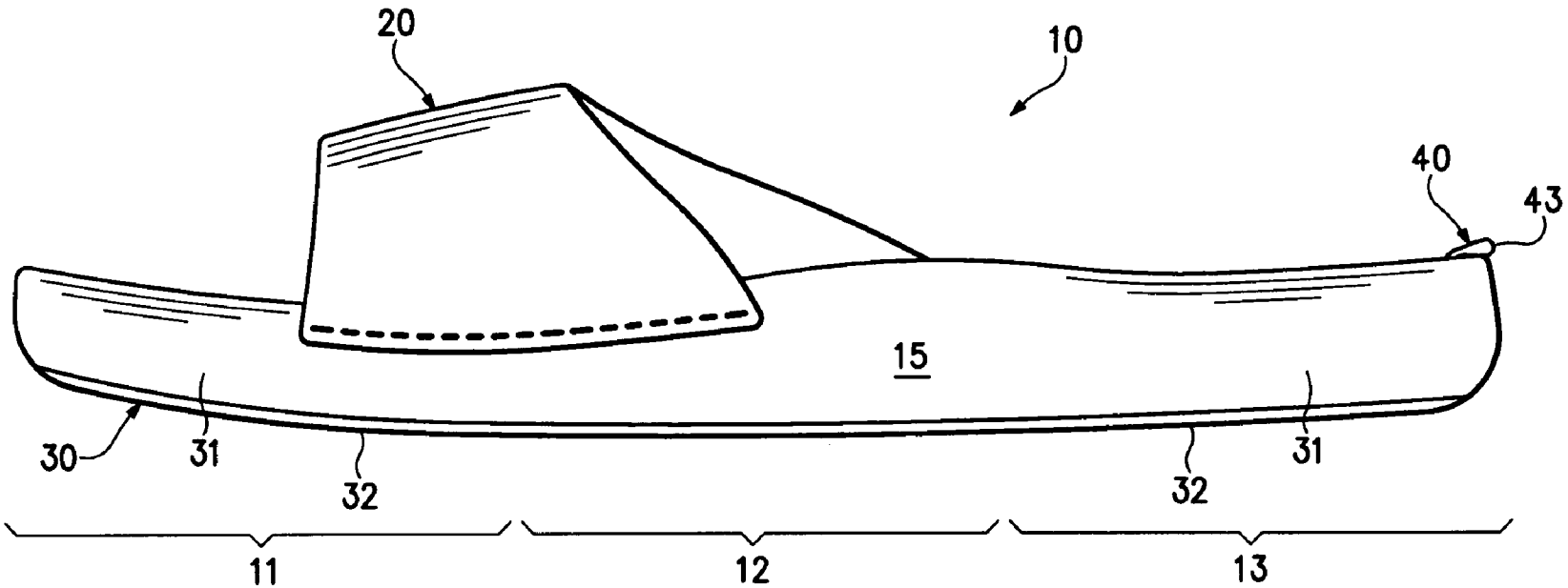
FIG. 2 is a medial side elevational view of the first article of footwear.
Figure 3:
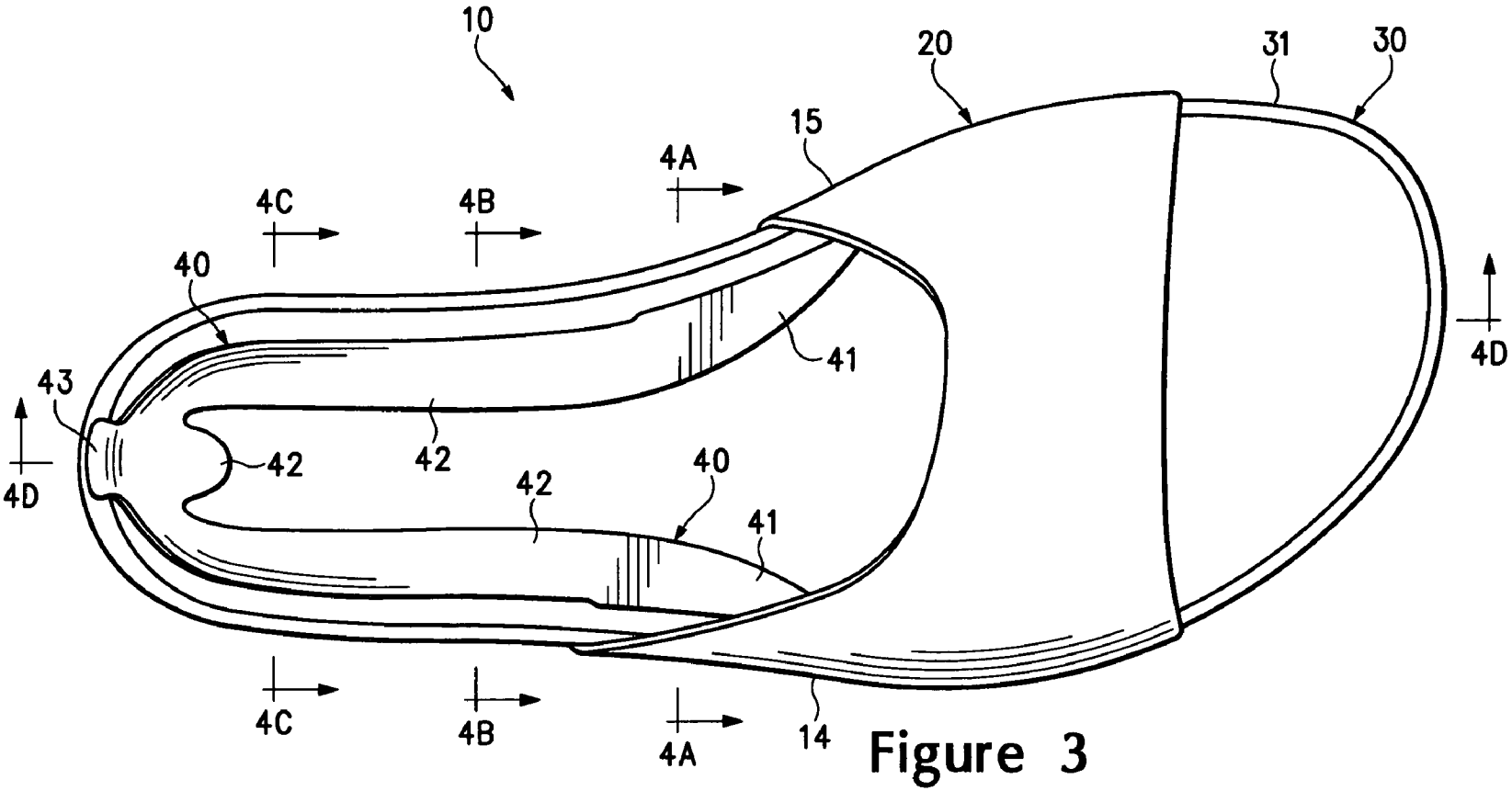
FIG. 3 is a top plan view of the first article of footwear.

Article of footwear 10 is depicted in FIGS. 1-4D as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration for a sandal that is limited to regions 11 and 12 and extends over a forward area of the foot. Consistent with many sandal configurations, upper 20 exposes portions of the toes, but may also have a configuration that covers the toes. Upper 20 may take the form of a wide band, one or more narrow bands, crossed bands, and the like as is the custom for sandals. Upper 20 may include laces, buckles, or another adjustment system for tightening upper 20 around the foot and securing the forward area of the foot within footwear 10.

Although upper 20 is depicted as being formed from a single layer of material, upper 20 may incorporate a plurality material elements (e.g., textiles, foam, leather, and synthetic leather) that are stitched or adhesively bonded together. Although aspects of the invention primarily relate to footwear with an open heel configuration, upper 20 may exhibit the general configuration of practically any other conventional or non-conventional upper. Accordingly, the structure of upper 20 may vary significantly within the scope of the present invention.

Upper 20 is secured to side portions of sole structure 30. Although stitching is utilized to join upper 20 to sole structure 30, a variety of other attachment methods may be utilized, including adhesives and thermobonding, for example. In some configurations, upper 20 may also be separable from sole structure 30 to permit customization of footwear 10.

Sole structure 30 is secured to upper 20 and has a configuration that extends between the foot and the ground. The primary elements of sole structure 30 are a midsole 31 and an outsole 32. Midsole 31 may be formed from a polymer foam material, such as polyurethane or ethylvinylacetate, that attenuates ground reaction forces when sole structure 30 is compressed between the foot and the ground. In addition to the polymer foam material, midsole 31 may incorporate a fluid-filled chamber, as disclosed in U.S. Pat. No. 4,183,156 to Rudy, for example, to further enhance the ground reaction force attenuation characteristics of sole structure 30. Outsole 32 is secured to a lower surface of midsole 31 and may be formed from a rubber material that provides a durable and wear-resistant surface for engaging the ground. In addition, outsole 32 may be textured to enhance the traction (e.g., friction) properties between footwear 10 and the ground. Although this configuration for sole structure 30 is suitable for footwear 10, a plurality of alternate configurations may also be utilized. For example, outsole 32 may be absent, substantially all of sole structure 30 may be formed from a rubber material, or elements of sole structure 30 may be removable and replaceable to permit customization of footwear 10. Accordingly, sole structure 30 may exhibit a variety of configurations within the scope of the present invention.

Figure 5A:
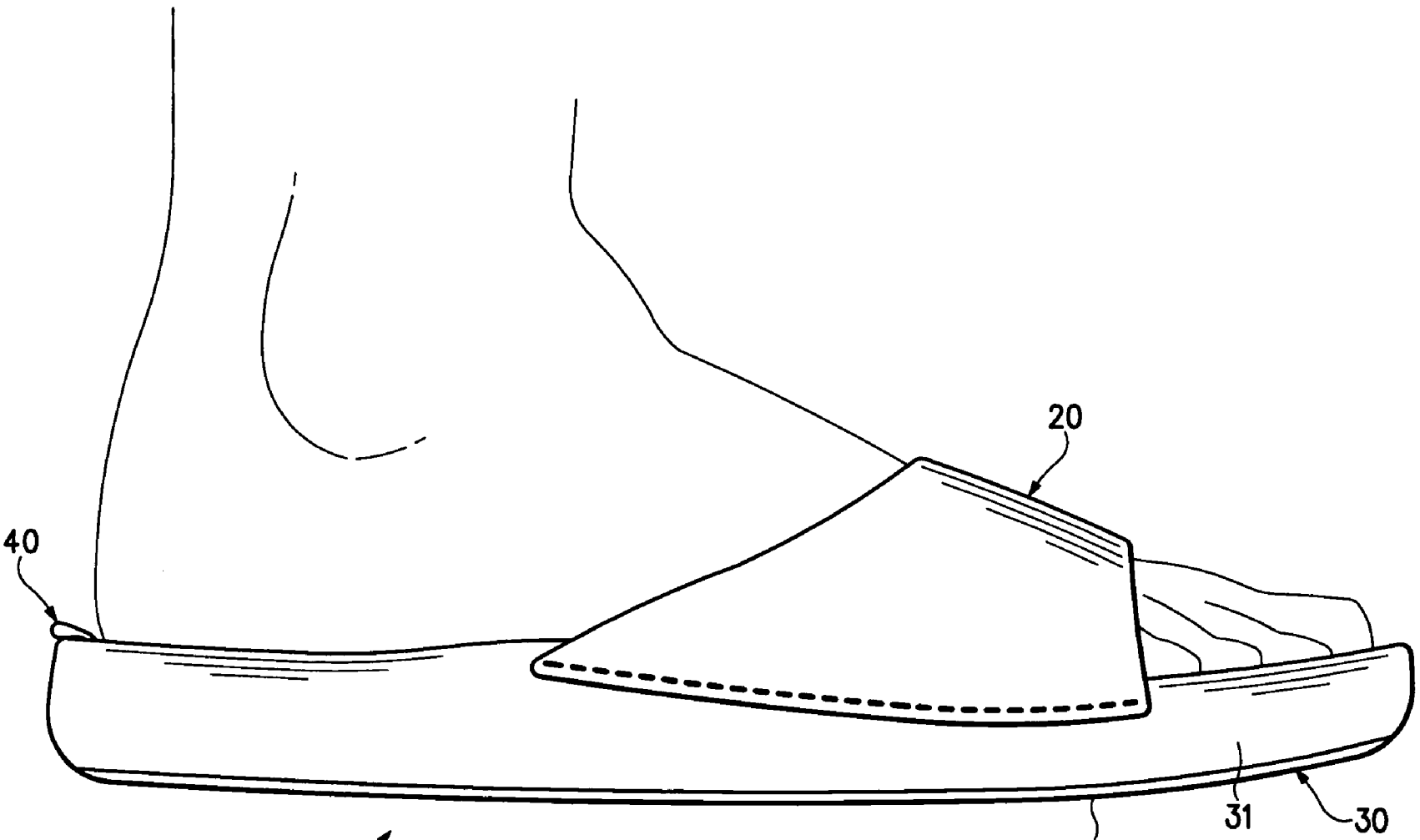
FIGS. 5A and 5B are lateral elevational views of the first article of footwear that depict the first article of footwear in a first configuration and a second configuration.
Figure 5B:
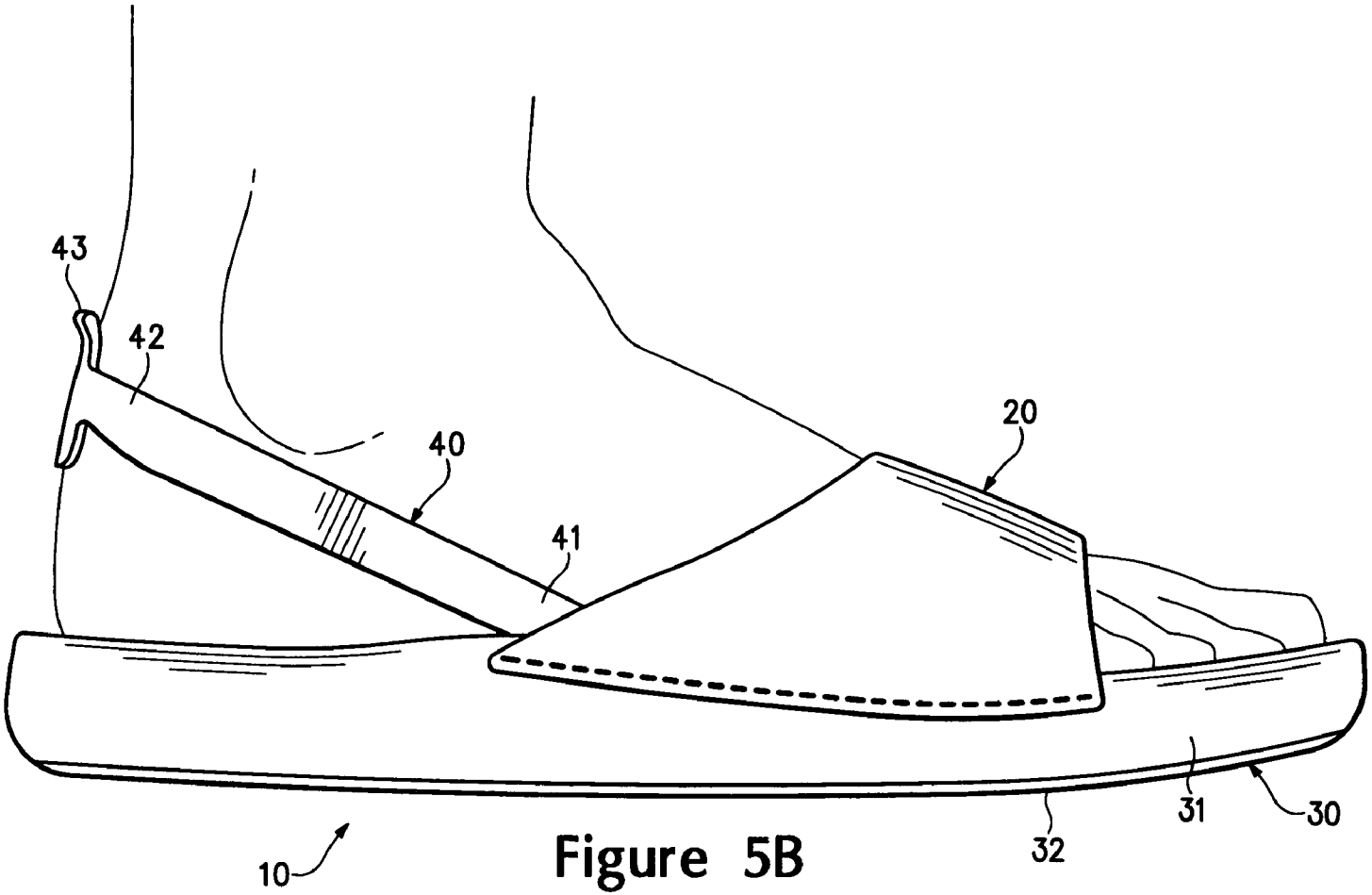
Figure 6:
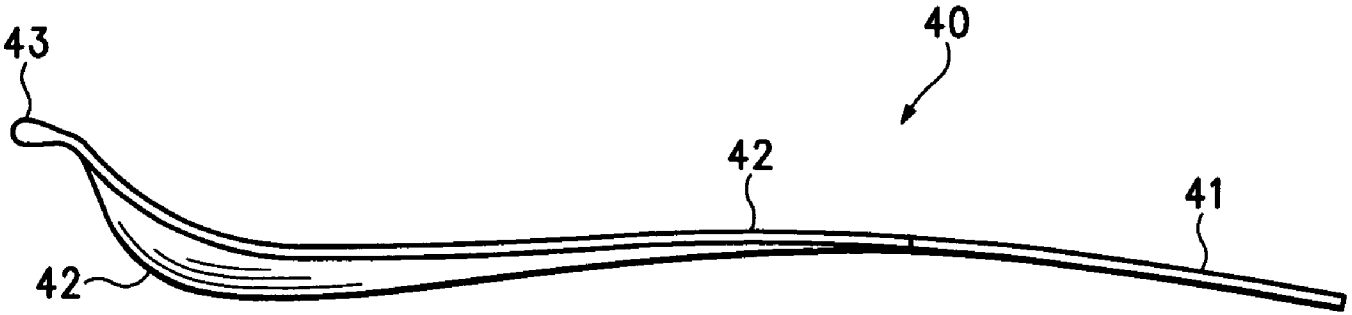
FIG. 6 is a lateral side elevational view of a strap of the first article of footwear.
Figure 7:
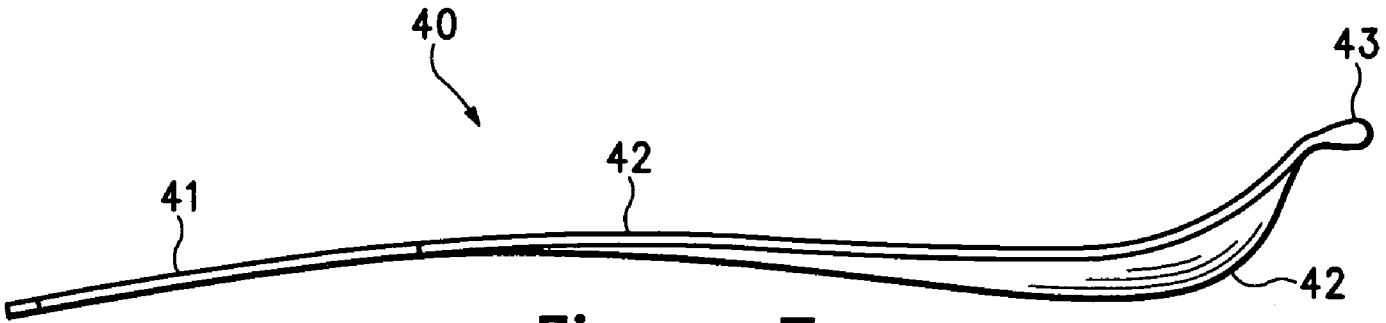
FIG. 7 is a medial side elevational view of the strap.

In addition to upper 20 and sole structure 30, footwear 10 includes a heel strap 40 that may be selectively utilized to limit the ease with which the foot exits footwear 10. With reference to FIG. 5A, footwear 10 is depicted in a first configuration, wherein heel strap 40 is located adjacent the upper surface of sole structure 30 and is between the foot and sole structure 30. In this configuration, the foot may be removed from footwear 10 with relative ease. That is, merely moving the foot rearward is generally sufficient to separate the foot from footwear 10. With reference to FIG. 5B, footwear 10 is depicted in a second configuration, wherein heel strap 40 extends around the heel of the foot and is spaced from the upper surface of sole structure 30. In this configuration, heel strap 40 prevents the foot from being removed from footwear 10. That is, heel strap 40 limits rearward movement of the foot relative to footwear 10. Accordingly, the wearer may selectively utilize heel strap 40 (i.e., by wearing footwear 10 in the first configuration or the second configuration) to modify the ease with which the foot may be separated from footwear 10.

When walking or otherwise moving slowly, the user may desire to wear footwear 10 in the first configuration as separation of the foot from footwear 10 is not likely. If, however, the wearer chooses to move more quickly, engage in various athletic activities, or run, for example, the user may desire to wear footwear 10 in the second configuration to prevent or otherwise decrease the probability that the foot will be inadvertently removed from footwear 10. Accordingly, the wearer may selectively utilize footwear 10 depending upon the activities that the wearer intends to engage in.

Heel strap 40 has a generally U-shaped configuration that includes a pair of end areas 41 and a central area 42, as depicted in FIGS. 6-9B. Each of end areas 41 are secured to sole structure 30 in midfoot region 12. In some configurations of footwear 10, end areas 41 may be secured to sole structure 30 in forefoot region 11 or heel region 13. Central area 42 extends rearward from end areas 41 and extend through each of regions 12 and 13 and is positioned around the periphery of sole structure 30. More particularly, central area 42 is shaped to extend along lateral side 14, medial side 15, and around the rounded portion of heel region 13.

Figure 4A:
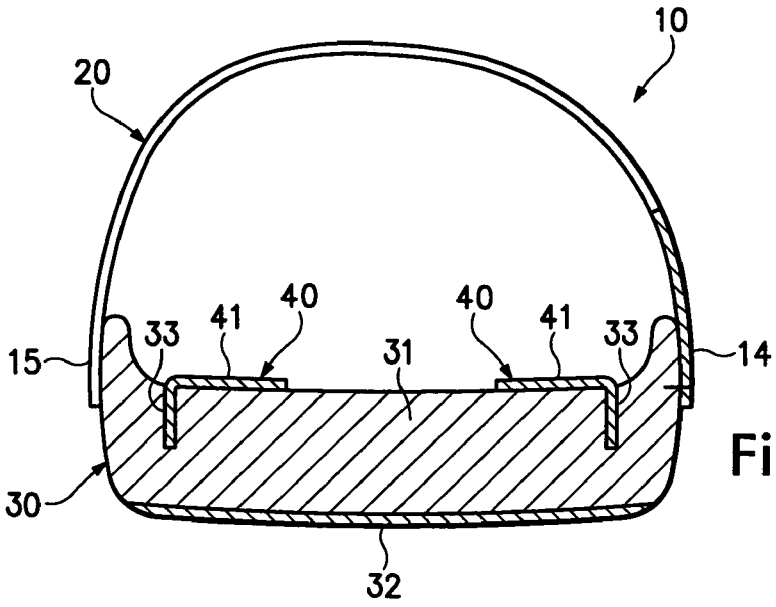
FIGS. 4A-4D are cross-sectional views of the first article of footwear, as defined by section lines 4A-4D in FIG. 3.

Each of end areas 41 are secured to sole structure 30 in a location that is spaced inward from lateral side 14 and medial side 15, as depicted in FIG. 4A. More particularly, sole structure 30 defines a pair of incisions 33 that extend downward from the upper surface of midsole 31, and end areas 41 are located within incisions 33. A variety of mechanical fasteners or adhesives, for example, may be utilized to secure end areas 41 within incisions 33. As an alternative, end areas 41 may be secured to the sidewall of midsole 31, or end areas 41 may be secured to upper 20. Although incisions 33 are depicted as being limited to the portion of sole structure 30 that receives end areas 41, in some configurations a single incision may extend around sole structure 30. Furthermore, the use of incisions 33 is intended to provide an example of an attachment system for heel strap 40, and a variety of other attachment systems may be utilized within the scope of the invention.

Figure 4B:
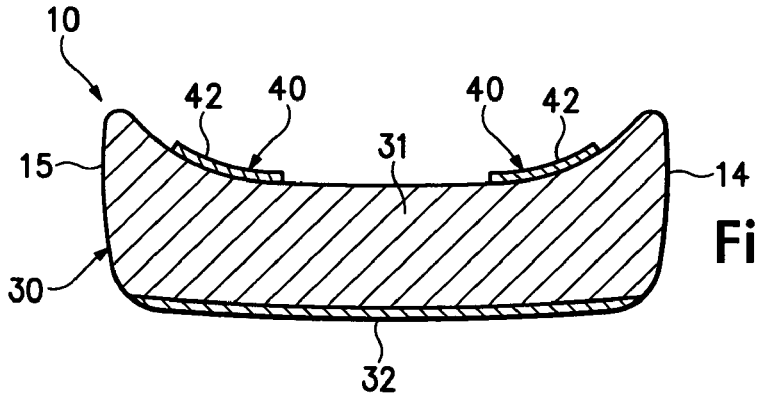
Figure 4C:
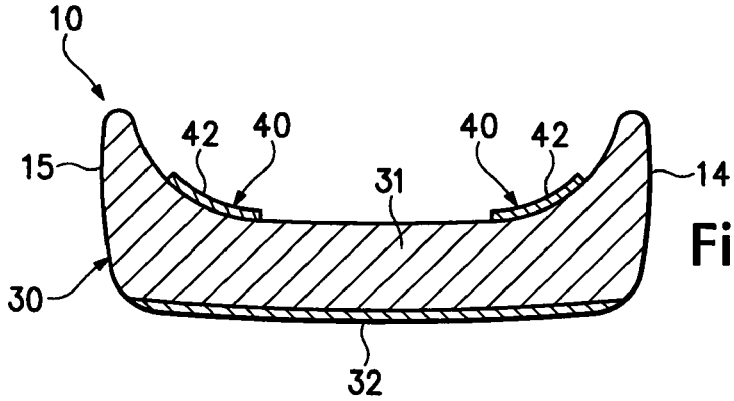
Figure 4D:
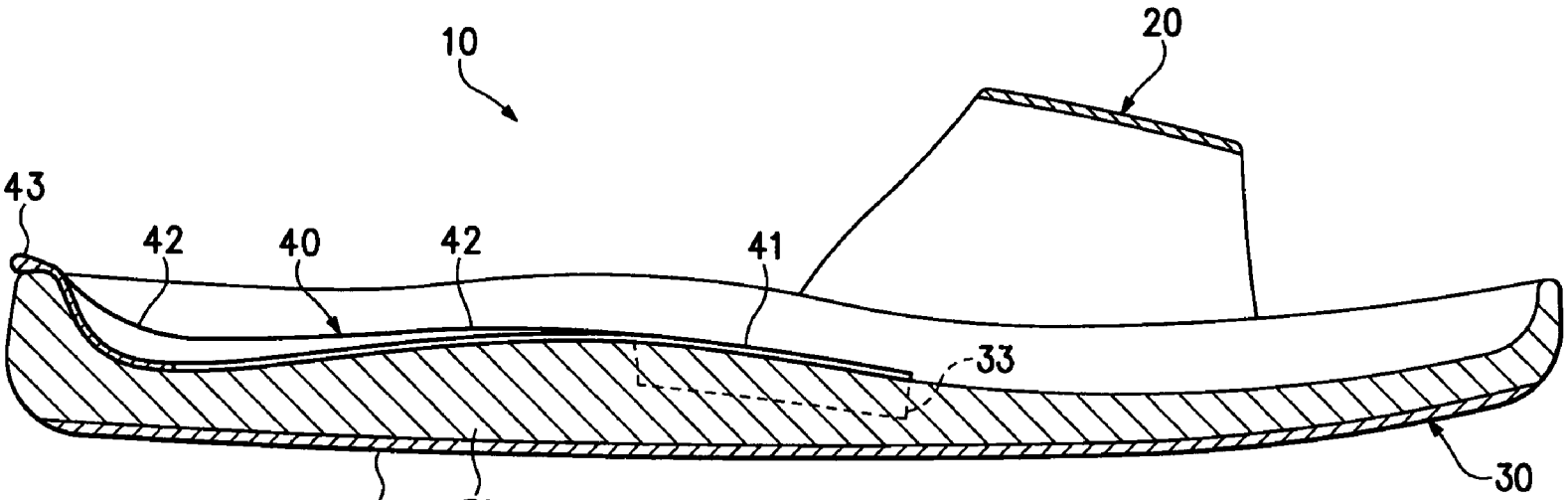
Figures 8, 9A, 9B:
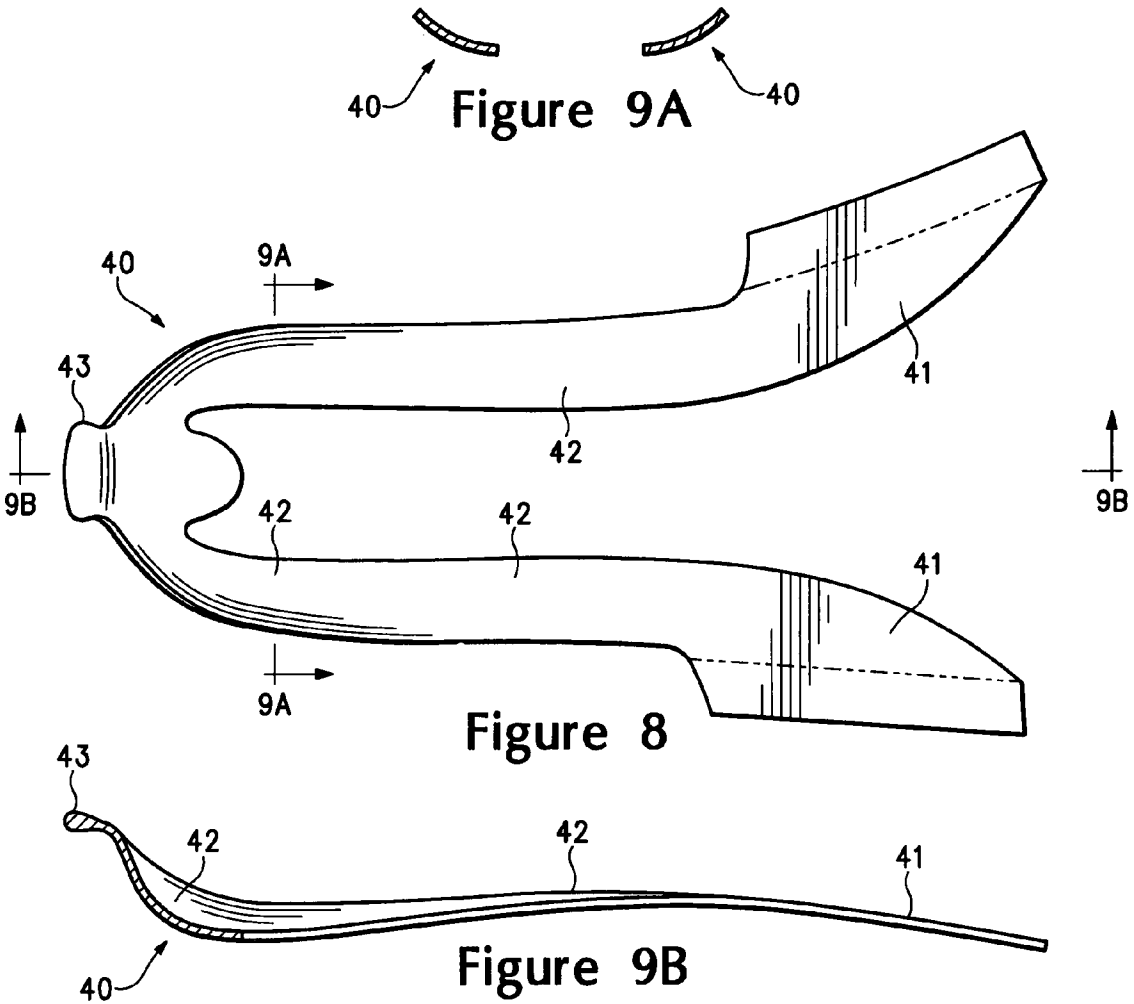
FIG. 8 is a top plan view of the strap.
FIGS. 9A and 9B are cross-sectional views of the strap, as defined by section lines 9A and 9B in FIG. 8.

The upper surface of sole structure 30 forms a foot-supporting surface that is contoured to conform with a shape of the lower (i.e., plantar) surface of the foot. More particularly, the upper surface of sole structure 30 has a generally concave configuration that forms a depression for receiving the foot. That is, the periphery of the foot-supporting surface is raised to define an area for receiving the foot. At the periphery, therefore, the foot-supporting surface has an upwardly-curved configuration. Heel strap 40 has a contoured or otherwise three-dimensional configuration that conforms with the raised periphery in the upper surface of sole structure 30 (i.e., the foot-supporting surface). With reference to FIGS. 4B-4D heel strap 40 has a curved configuration that lays adjacent to the foot-supporting surface and conforms with the contours of the upper surface. Even when heel strap 40 is separate from the foot-supporting surface, as depicted in FIGS. 9A and 9B, heel strap 40 retains the contoured or otherwise three-dimensional configuration.

Suitable materials for heel strap 40 include a variety of stretchable materials, such as rubber, nylon, or textiles incorporating elastane fibers, that are sufficiently elastic to stretch around the heel of the wearer and resilient enough to hold the heel against sole structure 30. Heel strap 40 is depicted as a single piece strap, but may include a reinforcement at end areas 41 or central area 42. Heel strap 40 may be any suitable width, but generally ranges between 5 and 15 millimeters. In addition, heel strap 40 may include a tab 43, which is depicted as having a semi-circular shape but may be square, rectangular, or any other suitable shape that allows the wearer to pull heel strap 40 onto or off the heel.

Figure 10:
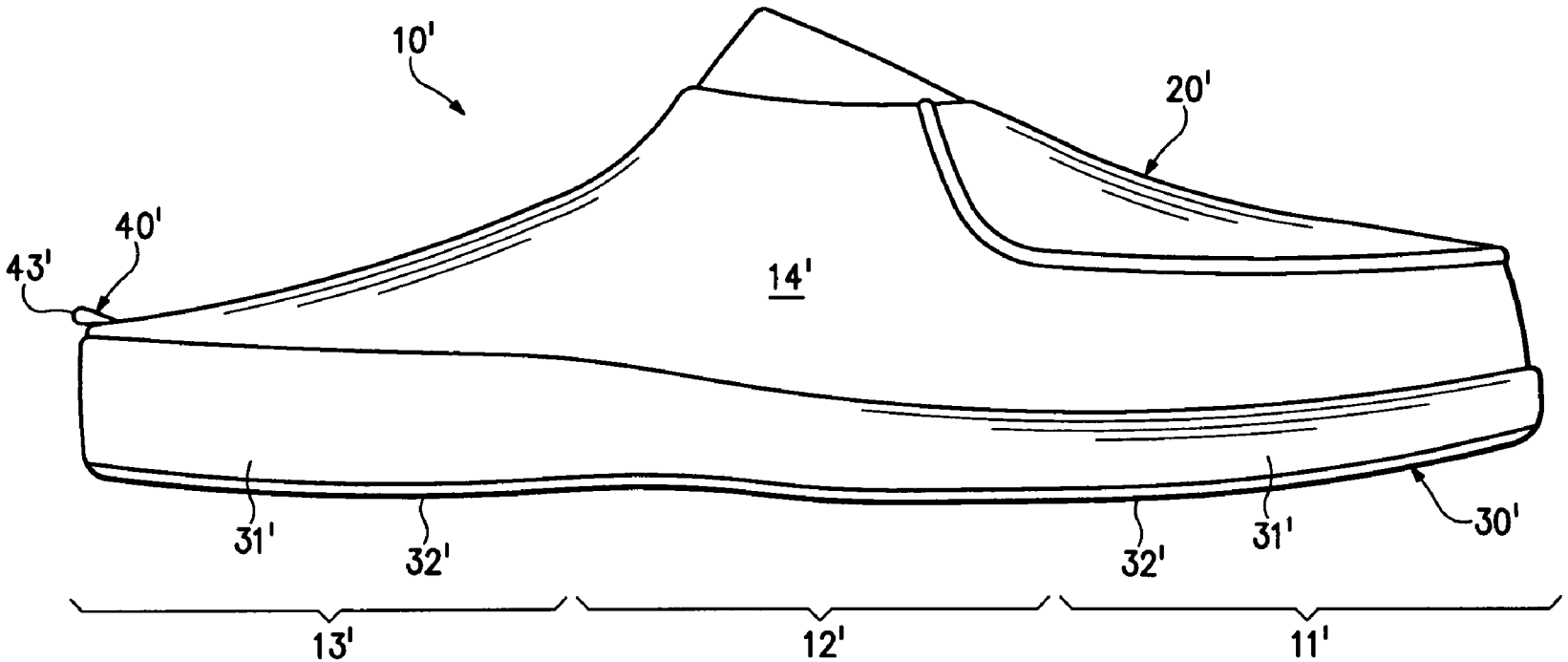
FIG. 10 is a lateral side elevational view of a second article of footwear having a configuration of a clog.
Figure 11:
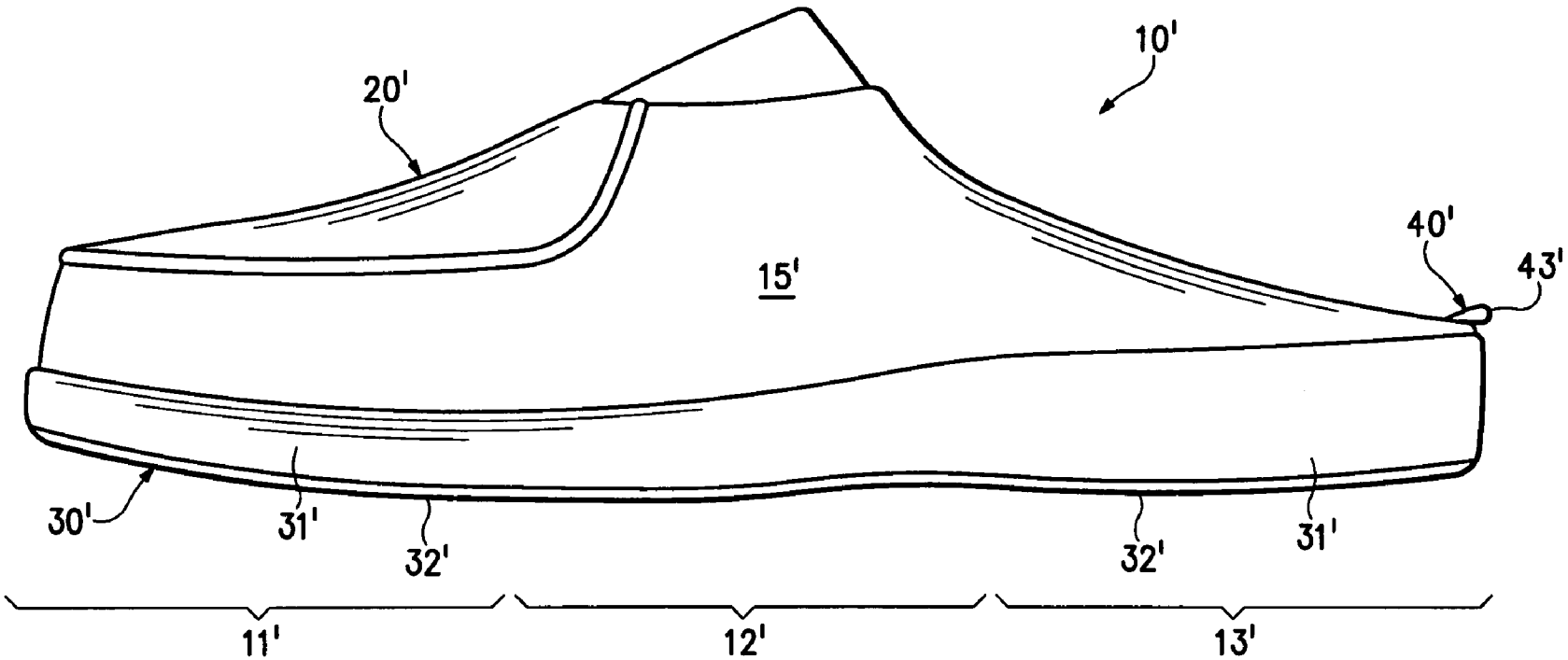
FIG. 11 is a medial side elevational view of the second article of footwear.
Figure 12:
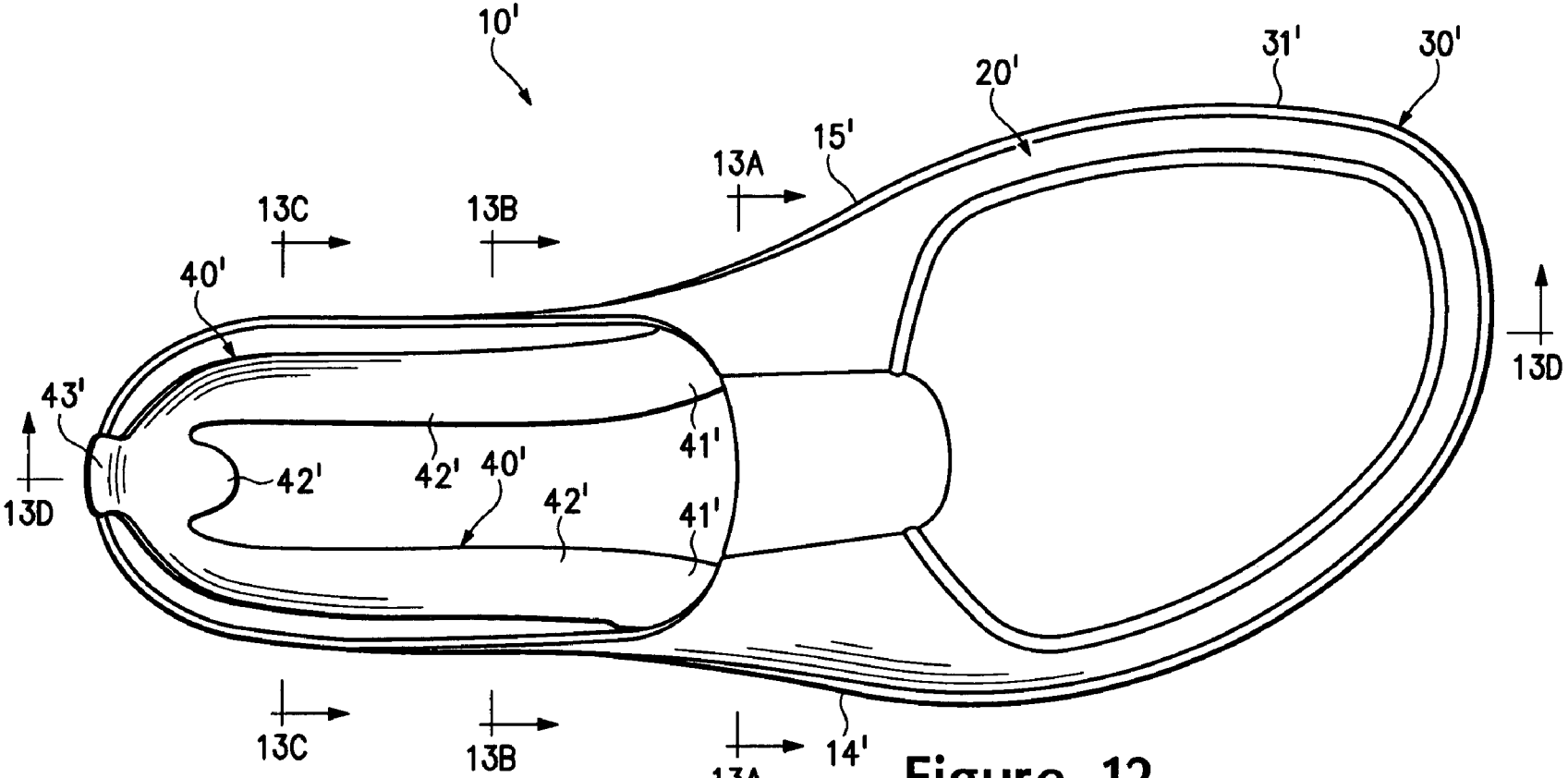
FIG. 12 is a top plan view of the second article of footwear.
Figure 13A:
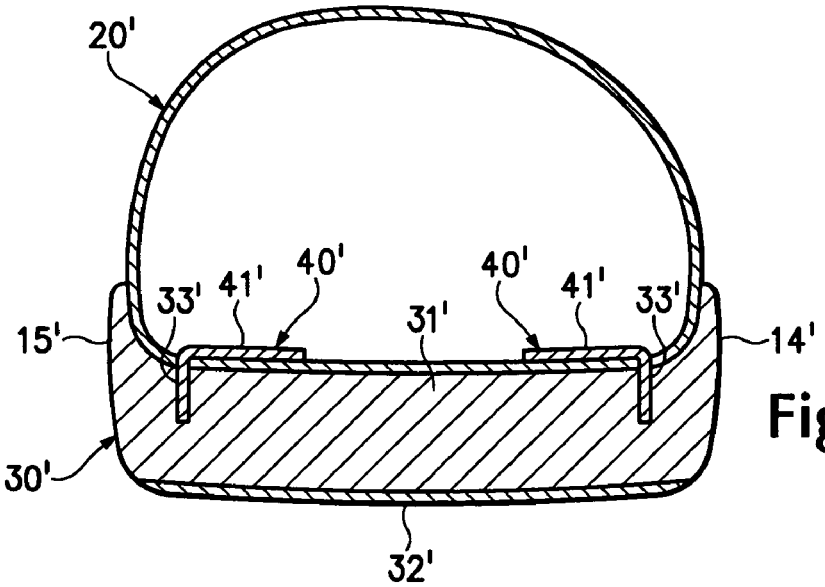
FIGS. 13A-13D are cross-sectional views of the second article of footwear, as defined by section lines 13A-13D in FIG. 12.
Figure 13B:
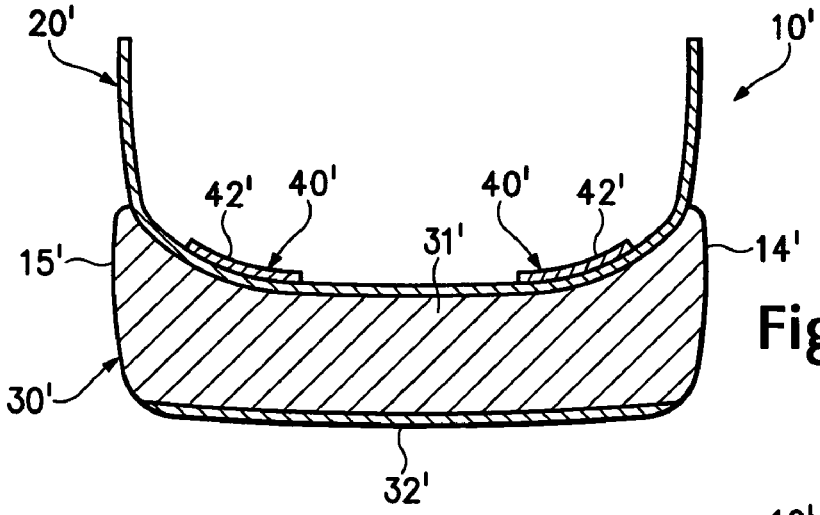
Figure 13C:
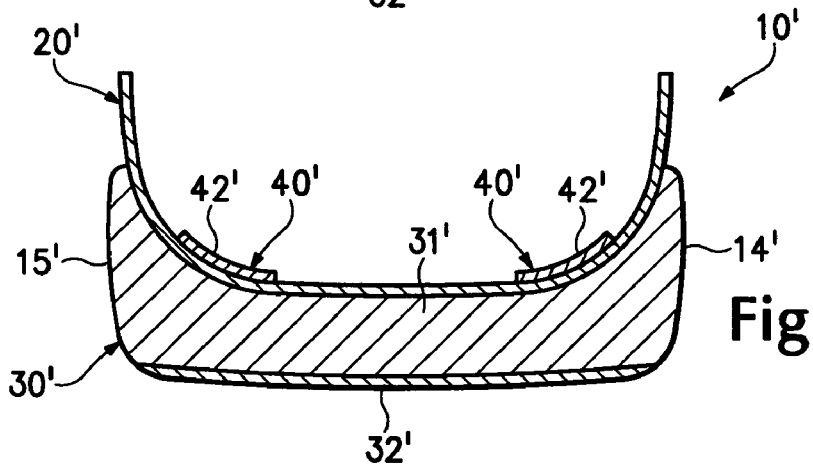
Figure 13D:
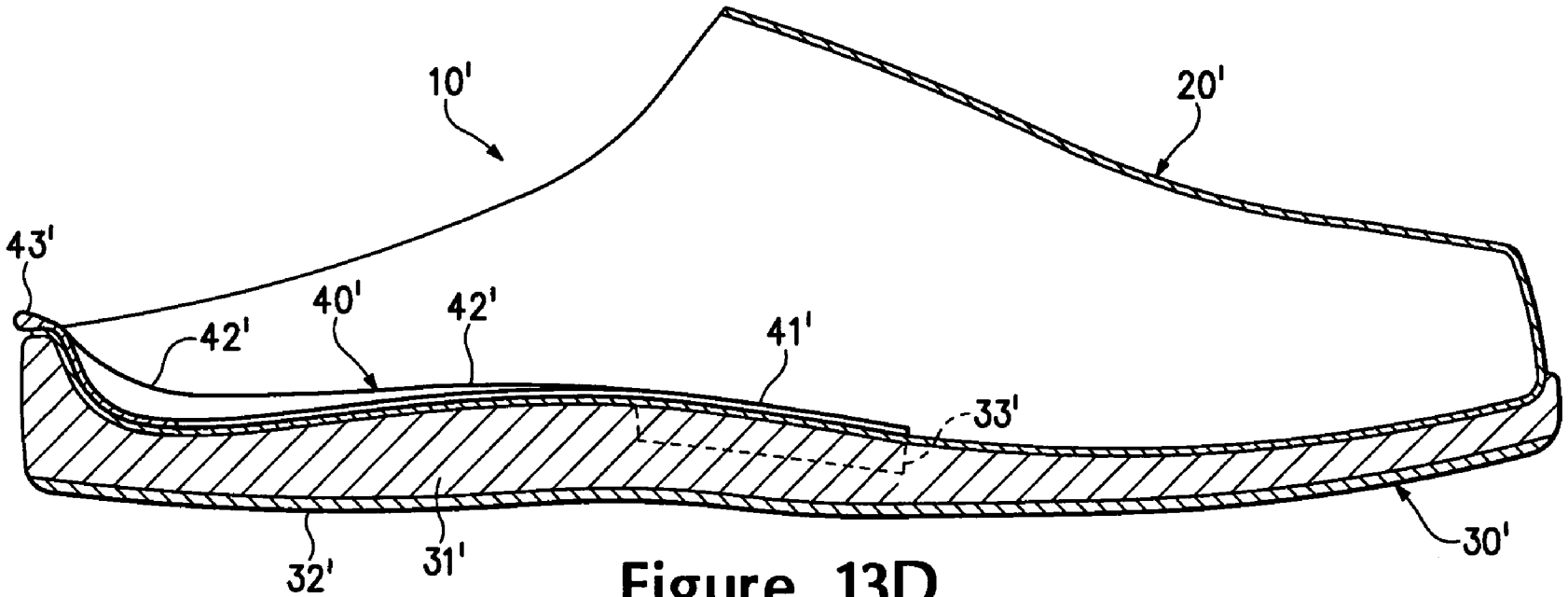

Article of footwear 10' is depicted in FIGS. 10-13D as including an upper 20' and a sole structure 30'. For reference purposes, footwear 10' may be divided into three general regions: a forefoot region 11', a midfoot region 12', and a heel region 13', as shown in FIGS. 10 and 11. Footwear 10' also includes a lateral side 14' and a medial side 15'. Forefoot region 11' generally includes portions of footwear 10' corresponding with the toes and the joints connecting the metatarsals with the phalanges. Midfoot region 12' generally includes portions of footwear 10' corresponding with the arch area of the foot, and heel region 13' corresponds with rear portions of the foot, including the calcaneus bone. Lateral side 14' and medial side 15' extend through each of regions 11'-13' and correspond with opposite sides of footwear 10'. Regions 11'-13' and sides 14'-15' are not intended to demarcate precis areas of footwear 10'. Rather, regions 11'-13' and sides 14'-15' are intended to represent general areas of footwear 10' to aid in the following discussion. In addition to footwear 10', regions 11'-13' and sides 14'-15' may also be applied to upper 20', sole structure 30', and individual elements thereof.

Upper 20' is depicted as having a substantially conventional configuration for a clog that covers a forward area of the foot, including the toes, in forefoot region 11' and midfoot region 12'. Portions of upper 20' also extend into heel region 13' and along lateral side 14' and medial side 15'. Further portions of upper 20' extend along the upper surface of sole structure 30' and are located, therefore, under the foot to form a foot-supporting surface for footwear 10'. Upper 20' may include laces, buckles, or another adjustment system for tightening upper 20' around the foot and securing the forward area of the foot within footwear 10'.

Although upper 20' is depicted as being formed from a single layer of material, upper 20' may incorporate a plurality material elements (e.g., textiles, foam, leather, and synthetic leather) that are stitched or adhesively bonded together. Although aspects of the invention primarily relate to footwear with an open heel configuration, upper 20' may exhibit the general configuration of practically any other conventional or non-conventional upper. Accordingly, the structure of upper 20' may vary significantly within the scope of the present invention.

Upper 20' is secured to the upper surface of sole structure 30', but may also have a configuration that is secured to sides of sole structure 30', as in footwear 10. Although adhesives are utilized to join upper 20' to sole structure 30', a variety of other attachment methods may be utilized, including stitching and thermobonding, for example. In some configurations, upper 20' may also be separable from sole structure 30' to permit customization of footwear 10'.

Sole structure 30' is secured to upper 20' and has a configuration that extends between the foot and the ground. The primary elements of sole structure 30' are a midsole 31' and an outsole 32'. Midsole 31' may be formed from a polymer foam material, such as polyurethane or ethylvinylacetate, that attenuates ground reaction forces when sole structure 30' is compressed between the foot and the ground. In addition to the polymer foam material, midsole 31' may incorporate a fluid-filled chamber, as disclosed in U.S. Pat. No. 4,183,156 to Rudy, for example, to further enhance the ground reaction force attenuation characteristics of sole structure 30'. Outsole 32' is secured to a lower surface of midsole 31' and may be formed from a rubber material that provides a durable and wear-resistant surface for engaging the ground. In addition, outsole 32' may be textured to enhance the traction (e.g., friction) properties between footwear 10' and the ground. Although this configuration for sole structure 30' is suitable for footwear 10, a plurality of alternate configurations may also be utilized. For example, outsole 32' may be absent, substantially all of sole structure 30' may be formed from a rubber material, or elements of sole structure 30' may be removable and replaceable to permit customization of footwear 10'. Accordingly, sole structure 30' may exhibit a variety of configurations within the scope of the present invention.

Figure 14A:
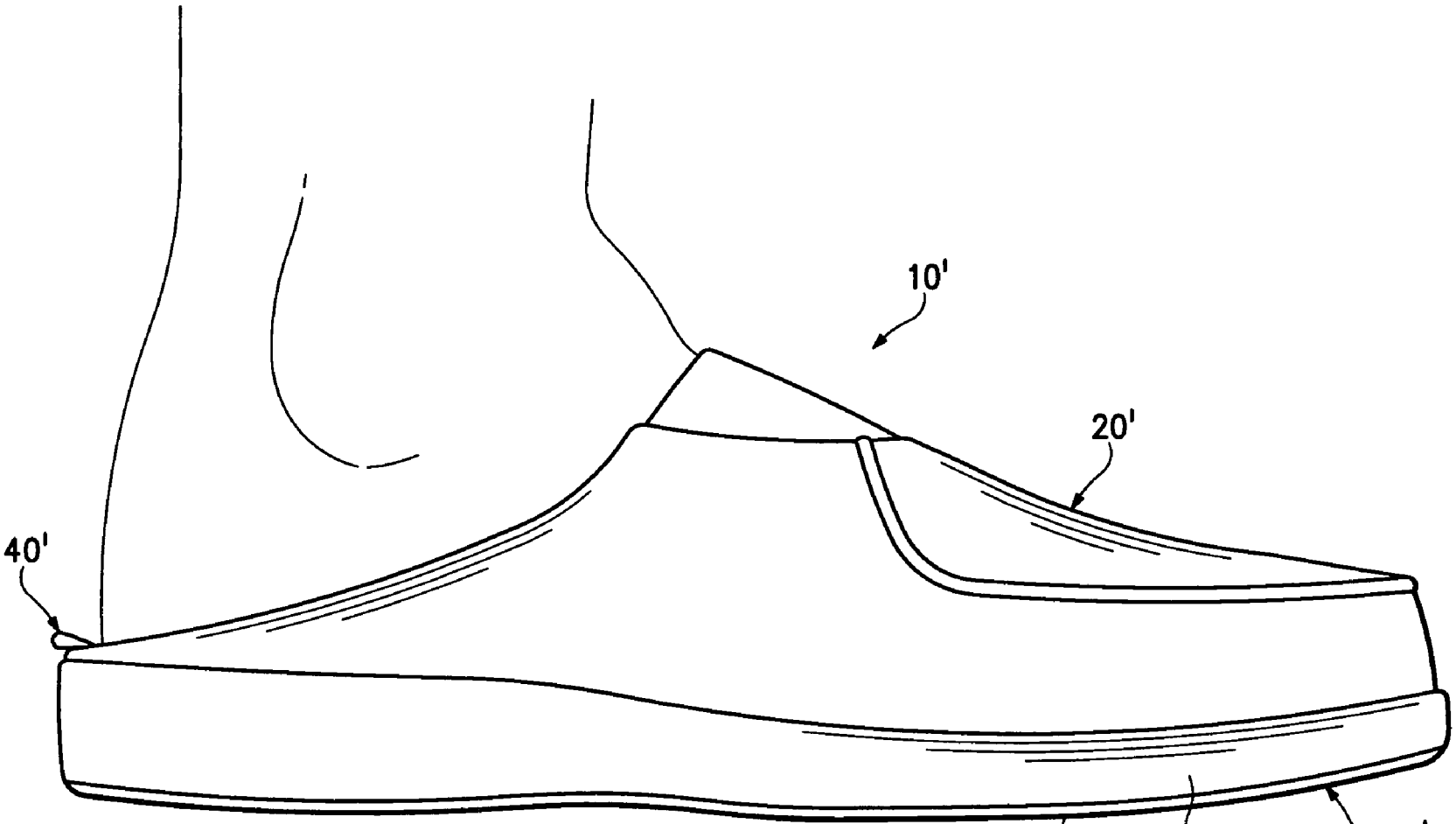
FIGS. 14A and 14B are lateral elevational views of the second article of footwear that depict the second article of footwear in a first configuration and a second configuration.
Figure 14B:
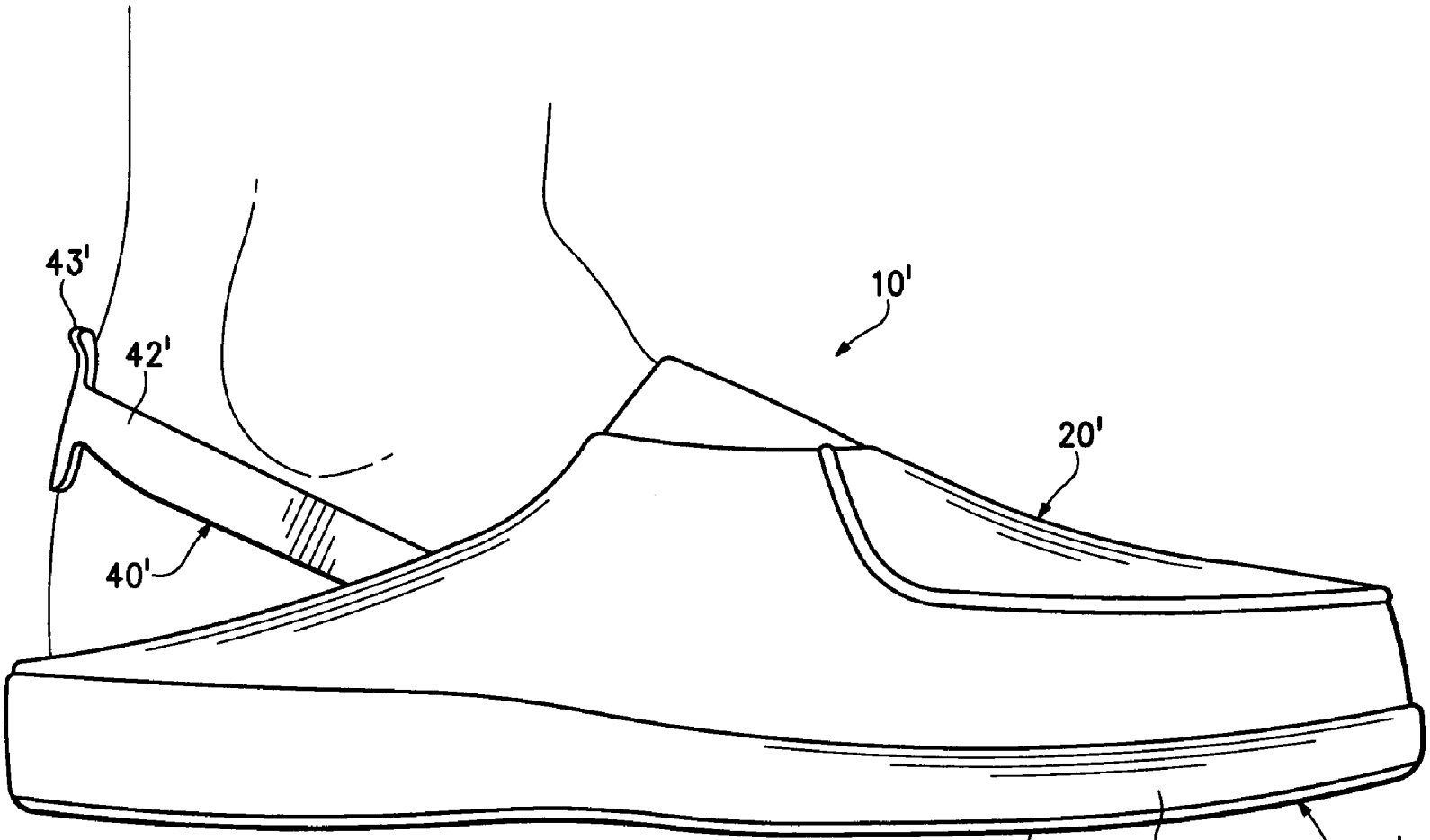

In addition to upper 20' and sole structure 30', footwear 10' includes a heel strap 40'that may be selectively utilized to limit the ease with which the foot exits footwear 10'. With reference to FIG. 14A, footwear 10' is depicted in a first configuration, wherein heel strap 40' is located adjacent the upper surface of sole structure 30' and is between the foot and sole structure 30'. In this configuration, the foot may be removed from footwear 10' with relative ease. That is, merely moving the foot rearward is generally sufficient to separate the foot from footwear 10'. With reference to FIG. 14B, footwear 10' is depicted in a second configuration, wherein heel strap 40' extends around the heel of the foot and is spaced from the upper surface of sole structure 30'. In this configuration, heel strap 40' prevents the foot from being removed from footwear 10'. That is, heel strap 40' limits rearward movement of the foot relative to footwear 10'. Accordingly, the wearer may selectively utilize heel strap 40' (i.e., by wearing footwear 10' in the first configuration or the second configuration) to modify the ease with which the foot may be separated from footwear 10'.

When walking or otherwise moving slowly, the user may desire to wear footwear 10' in the first configuration as separation of the foot from footwear 10' is not likely. If, however, the wearer chooses to move more quickly, engage in various athletic activities, or run, for example, the user may desire to wear footwear 10' in the second configuration to prevent or otherwise decrease the probability that the foot will be inadvertently removed from, footwear 10'. Accordingly, the wearer may selectively utilize footwear. 10' depending upon the activities that the wearer intends to engage in.

Heel strap 40' has a generally U-shaped configuration that includes a pair of end areas 41' and a central area 42'. Each of end areas 41' are secured to sole structure 30' in midfoot region 12'. In some configurations of footwear 10', end areas 41' may be secured to sole structure 30' in forefoot region 11' or heel region 13'. Central area 42' extends rearward from end areas 41' and extend through each of regions 12' and 13' and is positioned around the periphery of sole structure 30'. More particularly, central area 42' is shaped to extend along lateral side 14', medial side 15', and around the rounded portion of heel region 13'.

Each of end areas 41' extend through the portion of upper 20' that is are secured to sole structure 30' and are embedded within midsole 31' in a location that is spaced inward from lateral side 14' and medial side 15', as in footwear 10. That is, end areas 41' extend into a pair of incisions 33' in sole structure 30'. As alternatives, end areas 41' may be secured to upper 20' or secured to the sidewall of sole structure 30'. A variety of mechanical fasteners or adhesives, for example, may be utilized to secure end areas 41' to footwear 10'.

The upper surface of sole structure 30' is contoured to conform with a shape of the lower (i.e., plantar) surface of the foot, and upper 20' lays adjacent this surface to form a contoured foot-supporting surface. More particularly, the foot-supporting surface has a generally concave configuration that forms a depression for receiving the foot. That is, the periphery of the foot-supporting surface is raised to define an area for receiving the foot. At the periphery, therefore, the foot-supporting surface has an upwardly-curved configuration. As noted above, portions of upper 20' also extend into heel region 13' and along lateral side 14' and medial side 15'. The raised periphery that receives the foot is, therefore, formed by upper 20'. Heel strap 40' has a contoured or otherwise three-dimensional configuration that conforms with the raised periphery in the foot-supporting surface. Heel strap 40' has a curved configuration that lays adjacent to the raised periphery and conforms with the contours of the periphery. Even when heel strap 40' is separate from sole structure 30', heel strap 40' retains the contoured or otherwise three-dimensional configuration.

Suitable materials for heel strap 40' include a variety of stretchable materials, such as rubber, nylon, or textiles incorporating elastane fibers, that are sufficiently elastic to stretch around the heel of the wearer and resilient enough to hold the heel against sole structure 30'. Heel strap 40' is depicted as a single piece strap, but may include a reinforcement at end areas 41' or central area 42'. Heel strap 40' may be any suitable width, but generally ranges between 5 and 15 millimeters. In addition, heel strap 40' may include a tab 43', which is depicted as having a semi-circular shape but may be square, rectangular, or any other suitable shape that allows the wearer to pull heel strap 40' onto or off the heel.

Based upon the above discussion, footwear 10 and 10' have an open heel configuration and a heel strap system that limits the ease with which the foot exits the footwear. In general, the foot-supporting surface of each of footwear 10 and 10' have a raised periphery. Whereas the raised periphery of footwear 10 is formed primarily by sole structure 30, the raised periphery of footwear 10' is formed primarily by upper 20'. In some embodiments, the raised periphery may be formed primarily by a combination of the upper and the sole structure. Accordingly, the raised periphery of the foot-supporting surface may be formed from the sole structure, the upper, or a combination of the sole structure and the upper.

The heel strap system in each of footwear 10 and footwear 10' may be selectively utilized by the wearer and respectively includes heel straps 40 and 40'. Each of heel straps 40 and 40' are contoured to conform with the shape of the raised periphery of the foot-supporting surface. That is, heel straps 40 and 40' are depicted as having a curve configuration that lays adjacent to the curved portions of the foot-supporting surface that form the raised periphery when footwear 10 and 10' are used in the first configuration. In comparison with a flat or otherwise non-contoured strap, heel straps 40 and 40' may be more comfortable for the wearer to stand on when footwear 10 and 10' are in the first configuration. Furthermore, the contoured configuration of heel straps 40 and 40' may be more comfortable when placed against the heel in the second configuration An advantage of heel straps 40 and 40' is to permit the wearer to selectively convert footwear 10 and 10' between a first configuration wherein the foot may be easily removed from footwear 10 and 10' and a second configuration wherein that limits the ease with which the foot exits footwear 10 and 10'. Another advantage is that heel straps 40 and 40', when utilized in the second configuration, may hold the heel area of the foot against the foot-supporting surface. In many articles of footwear with an open heel configuration, the heel region of the footwear separates from the plantar surface of the foot during every step. That is, as the foot rotates forward in the walking cycle, a space is formed between the plantar surface of the foot and the foot-supporting surface. Heel straps 40 and 40' may operate to hold the plantar surface of the foot in contact with the foot-supporting surfaces of sole structures 30 and 30' during the walking cycle.

Footwear 10 is disclosed as being a sandal, and footwear 10' is disclosed as being a clog. In addition to a sandal and a clog, the heel strap system disclosed above may be applied to other types of footwear having an open heel configuration, including a flip-flop, for example. The heel strap system disclosed above is not limited, however, to footwear having an open heel configuration and may be applied to other types of footwear with a closed heel, such as running shoes, basketball shoes, football shoes, dress shoes, and boots, for example.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

The invention claimed is:

1. An article of footwear for receiving a foot of a wearer, the footwear comprising:

an upper;

a sole structure secured to the upper; and a heel strap having a U-shaped configuration with a pair of end areas and a central area, the end areas being secured to at least one of the upper and the sole structure, and the central area being unsecured to the upper and the sole structure, at least one of the upper and the sole structure defining a foot-supporting surface with a raised periphery in at least a heel region of the footwear, the central area of the heel strap being a contoured portion of the heel strap that lays adjacent the raised periphery in the heel region and conforms with contours of the foot-supporting surface.

2. The article of footwear recited in claim 1, wherein the footwear has an open heel configuration.

3. The article of footwear recited in claim 2, wherein the footwear is a sandal.

4. The article of footwear recited in claim 2, wherein the footwear is a clog.

5. The article of footwear recited in claim 4, wherein the raised periphery is formed by each of the upper and the sole structure.

6. The article of footwear recited in claim 1, wherein the raised periphery is a curved area of the foot-supporting surface, and the contoured portion of the heel strap is curved to contact the curved area of the foot-supporting surface.

7. The article of footwear recited in claim 1, wherein the sole structure includes an outsole and a midsole, and the heel strap is secured to the midsole.

8. The article of footwear recited in claim 1, wherein the central area of the strap includes a tab.

9. The article of footwear recited in claim 1, wherein the sole structure defines a pair of incisions spaced inward from sides of the footwear, and the end areas are secured to the sole structure within the incisions.

10. An article of footwear for receiving a foot of a wearer, the footwear comprising:

a sole structure;

an upper secured to the sole structure and located in at least a forefoot region of the footwear; and a strap having a U-shaped configuration with a pair of end areas and a central area, the end areas being secured to the sole structure such that the central area extends around a periphery of the sole structure in at least a heel region of the footwear, the central area having a curved configuration that contacts a raised periphery of a foot-supporting surface of the footwear and conforms with contours of the foot-supporting surface, and the central area of the heel strap can be separated from the raised periphery of the foot-supporting surface and placed around a heel portion of the foot.

11. The article of footwear recited in claim 10, wherein the footwear has an open heel configuration.

12. The article of footwear recited in claim 11, wherein the footwear is a sandal.

13. The article of footwear recited in claim 11, wherein the footwear is a clog.

14. The article of footwear recited in claim 13, wherein the raised periphery is formed by each of the upper and the sole structure.

15. The article of footwear recited in claim 10, wherein the raised periphery is formed by an upper surface of the sole structure.

16. The article of footwear recited in claim 10, wherein the sole structure includes an outsole and a midsole, and the heel strap is secured to the midsole.

17. The article of footwear recited in claim 16, wherein the midsole defines a pair of incisions spaced inward from sides of the footwear, and the end areas are secured to the midsole within the incisions.

18. The article of footwear recited in claim 11, wherein the central area of the strap includes a tab.

19. An article of footwear for receiving a foot of a wearer, the footwear comprising:

an upper located in at least one of a forefoot region and a midfoot region of the footwear, the upper being absent in at least a portion of a heel region of the footwear to define an open heel configuration for the footwear;

a sole structure secured to the upper, the sole structure defining a pair of incisions spaced inward from sides of the sole structure;

a foot-supporting surface formed by at least one of the upper and the sole structure, the foot-supporting surface having a raised periphery in at least the heel region; and a heel strap with a pair of end areas and a central area, the end area being located within the incisions and secured to the sole structure, the central area extending around the raised periphery of the sole structure in at least the heel region and conforming with contours of the foot-supporting surface.

20. The article of footwear recited in claim 19, wherein the central area of the heel strap is a contoured area that lays adjacent the raised periphery of the foot-supporting surface in the heel region.

21. The article of footwear recited in claim 20, wherein the raised periphery is a curved area of the foot-supporting surface, and the contoured area of the heel strap is curved to contact the curved area of the foot-supporting surface.

22. The article of footwear recited in claim 19, wherein the footwear is one of a sandal and a clog.

23. The article of footwear recited in claim 19, wherein the central area of the strap includes a tab.

24. A method of assembling an article of footwear, the method comprising steps of:

providing a combination of an upper and a sole structure that are secured together, the upper extending over at least a front portion of a foot, and the sole structure having sides and a heel portion;

attaching two ends of a heel strap having a contoured and U-shaped configuration to the sides of the sole structure; and locating a central area of the heel strap around a periphery of an upper surface of the sole structure in at least the heel portion of the footwear such that contours of the central area lay adjacent the periphery.

25. The method recited in claim 24, wherein the step of attaching includes defining incisions in the sole structure and placing the ends of the heel strap within the incisions.

26. The method recited in claim 24, further including a step of selecting an elastic material for the heel strap.

27. A method of manufacturing an article of footwear for receiving a foot, the method comprising steps of:

securing an upper to a sole structure, the upper forming an open heel configuration for the footwear;

attaching ends of a heel strap having a contoured and U-shaped configuration to a medial side and a lateral side of the sole structure such that the heel strap lies against an upper surface of the sole structure and extends around a periphery of the upper surface in a heel region of the footwear and conforms with the contours of the upper surface; and structuring the strap to have a configuration that is separable from the upper surface of the sole structure and extendable around a heel of the foot.

28. The method recited in claim 27, wherein the step of attaching includes defining incisions in the sole structure and placing the ends of the heel strap within the incisions.

29. The method recited in claim 27, further including a step of selecting an elastic material for the heel strap.

* * * * *